US007389986B2

(12) United States Patent
Tsai

(10) Patent No.: US 7,389,986 B2
(45) Date of Patent: Jun. 24, 2008

(54) SOCCER TABLE WITH SPECIAL ENTERTAINMENT EFFECT

(76) Inventor: Jerry Tsai, No. 22, Lane 20, Zichiang Street, Taichung (TW)

( * ) Notice: Subject to any disclaimer, the term of this patent is extended or adjusted under 35 U.S.C. 154(b) by 109 days.

(21) Appl. No.: 11/071,213

(22) Filed: Mar. 4, 2005

(65) Prior Publication Data

US 2006/0197278 A1 Sep. 7, 2006

(51) Int. Cl.
*A63F 7/00* (2006.01)

(52) U.S. Cl. ..... 273/108.1; 273/108.1; 273/108.52

(58) Field of Classification Search ..... 273/108, 273/108.1, 108.22, 108.4, 108.52, 108.54, 273/317.3, 309; 473/10, 14, 22
See application file for complete search history.

(56) References Cited

U.S. PATENT DOCUMENTS 2,819,082 A * 1/1958 Peters ..... 273/108.53
3,112,930 A * 12/1963 Wertz ..... 273/108.52
5,320,350 A * 6/1994 Savage ..... 273/108.53
5,411,256 A * 5/1995 Savage ..... 273/108.53
6,623,004 B2 * 9/2003 Rossi et al. ..... 273/108.1

* cited by examiner

*Primary Examiner*—Nini Legesse
(74) *Attorney, Agent, or Firm*—Lowe, Hauptman, Ham & Berner, LLP

(57) ABSTRACT

The present invention provides a soccer table with special entertainment effect. The table frame of the soccer table has a table board, two long frames and two short frames mounted on the four sides of the table board. A predetermined number of control shanks are passing through the two long frames and can be translated and turned by player to control multiple shift blocks, so that the shift blocks can move a ball on the table board. An inner side of each the short frame is inwards recessed a concave curve surface. In the game, when the ball is hit to a curve surface, along the curve surface the ball will overfly and bounce to the table board. In addition, by the curve surface, the ball can be moved backward so that it is passed forward.

8 Claims, 9 Drawing Sheets

SOCCER TABLE WITH SPECIAL ENTERTAINMENT EFFECT

FIELD OF THE INVENTION

The present invention is related to a game device, and more particularly to a soccer table, in which a curve surface is designed on the inner sides of both ends respectively, so that a ball will overfly and rebound within the soccer table to bring entertainment effects while it touches the curve surface.

BACKGROUND OF THE INVENTION

FIG. 1 shows a conventional game soccer table 10, there are many control shanks 16 mounted on the two long frames 14 of a table frame 12, and a opening 20 is respectively mounted on two short frames 18 of the table frame 12, forming a goal. During a game, place a ball in the soccer table 10, the player flatly move and turn the control shanks 16 to make the puppets 22 on the control shank kick the ball into the opening 20, so the player can obtain score and imitate the soccer sport.

It is the purpose of this kind of game to move the ball into the opening 20. If the ball does not enter into the opening 20, it will hit the inner side 19 of the short frames 18. Because the inner side 19 of the prior soccer table is a vertical plane, when the ball hits it, the ball will rebound directly horizontally, without any interest. Additionally, the rebound distance would be affected easily for the block of puppets 22 while the ball rebounds.

Furthermore, the player only can kick forth and dribble the ball to the puppet at the front court with the puppet at the back court while attacking the opponent within a traditional soccer table. For example, a player controls the white puppets as shown in FIG. 1, usually the player would move the ball with puppet (a) at the back court to the puppet (b) at the front court and to the puppet (c) at further distance in orders. Therefore the attack in the conventional soccer table is unattractive.

SUMMARY OF THE INVENTION

It is therefore a primary object of the present invention to provide a soccer table to strengthen the entertainment of soccer tables.

It is a further object of the present invention to provide a soccer table with a kind of different way to pass a ball.

The present invention can be best understood through the following description and accompanying drawings wherein:

DETAILED DESCRIPTION OF THE PREFERRED EMBODIMENTS

Figure 1:
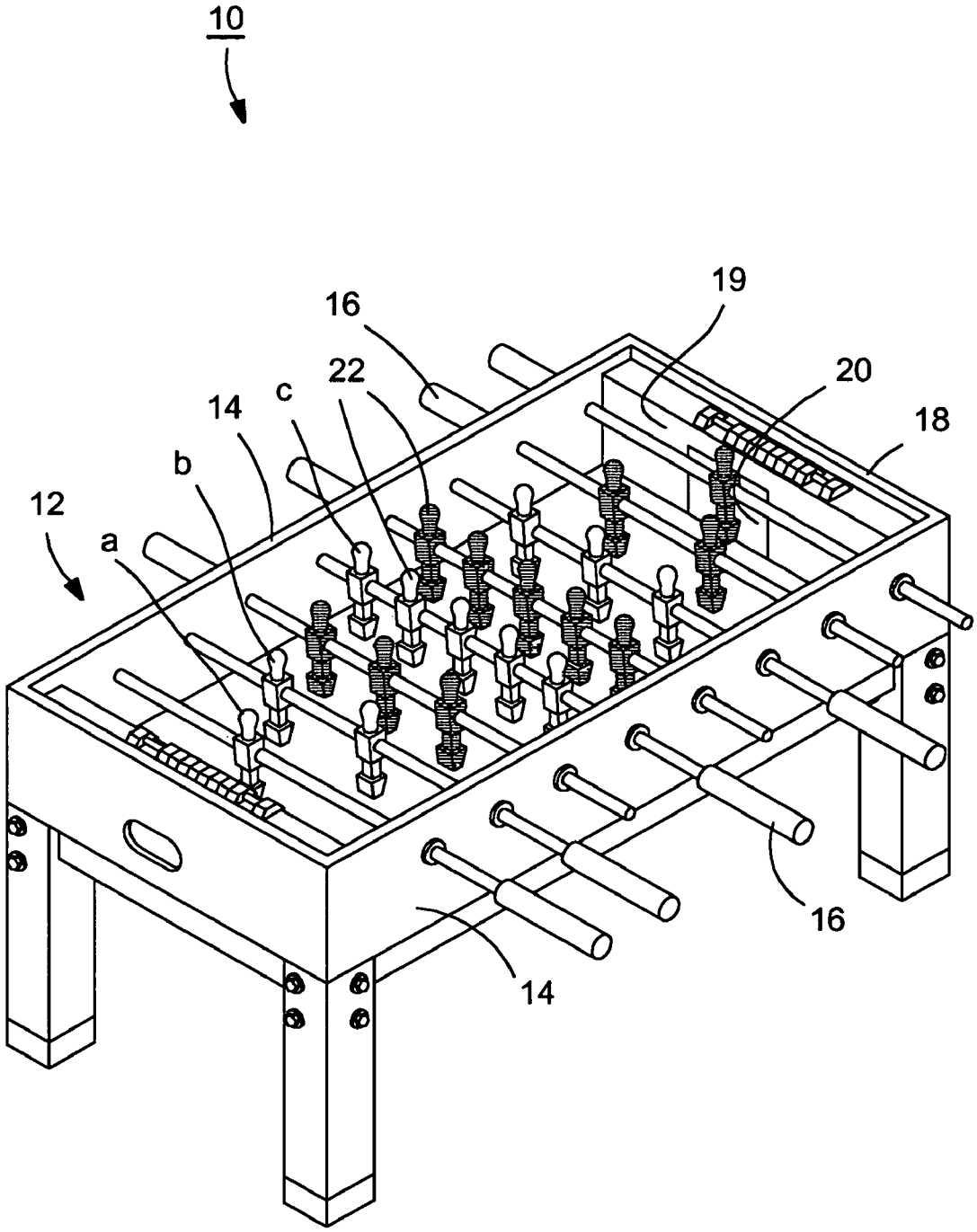
Fig. 1 PRIOR ART
FIG. 1 is a perspective view of a conventional soccer table.
Figure 2:
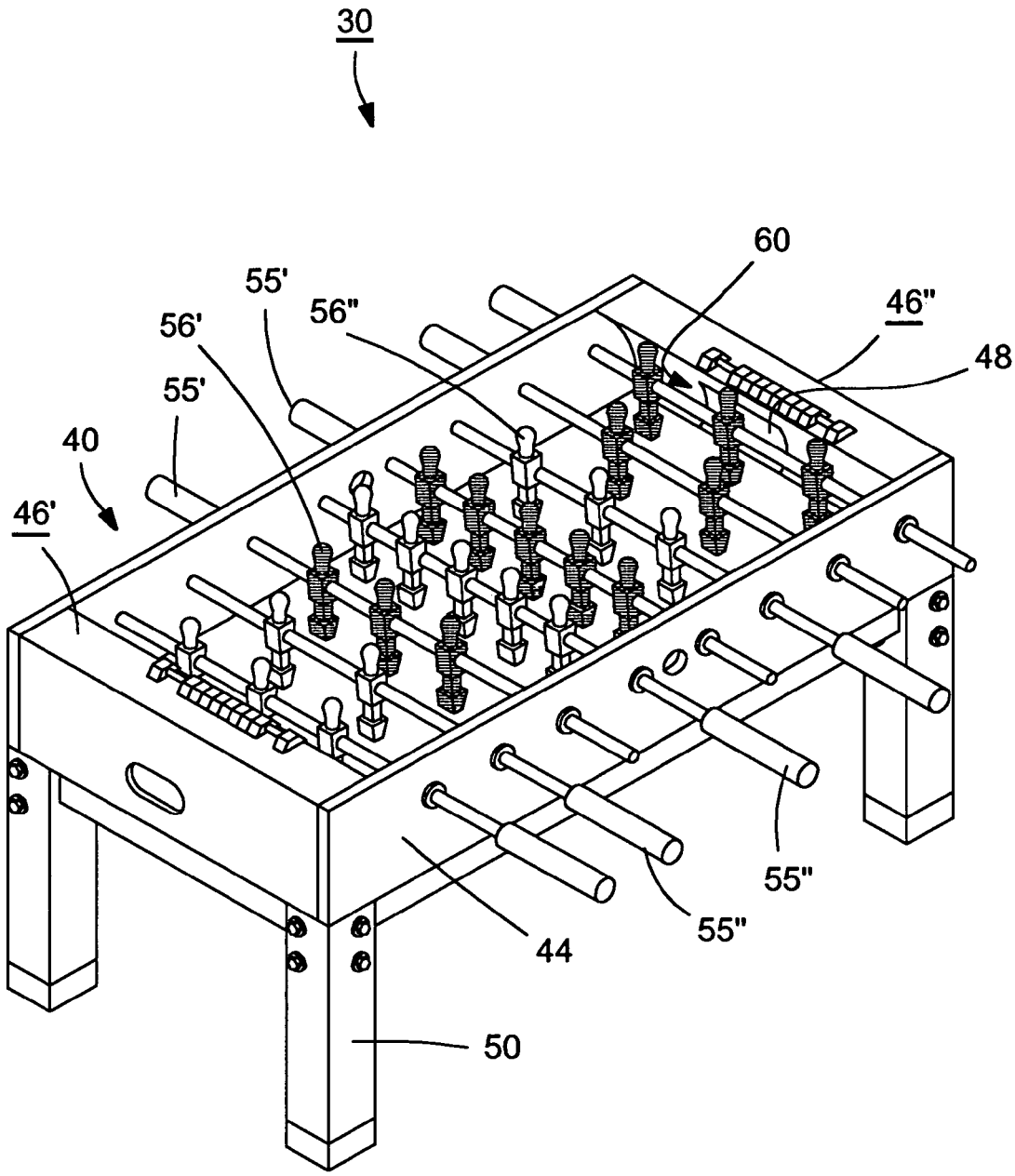
FIG. 2 is a perspective view of a preferred embodiment of the soccer table of the present invention.
Figure 3:
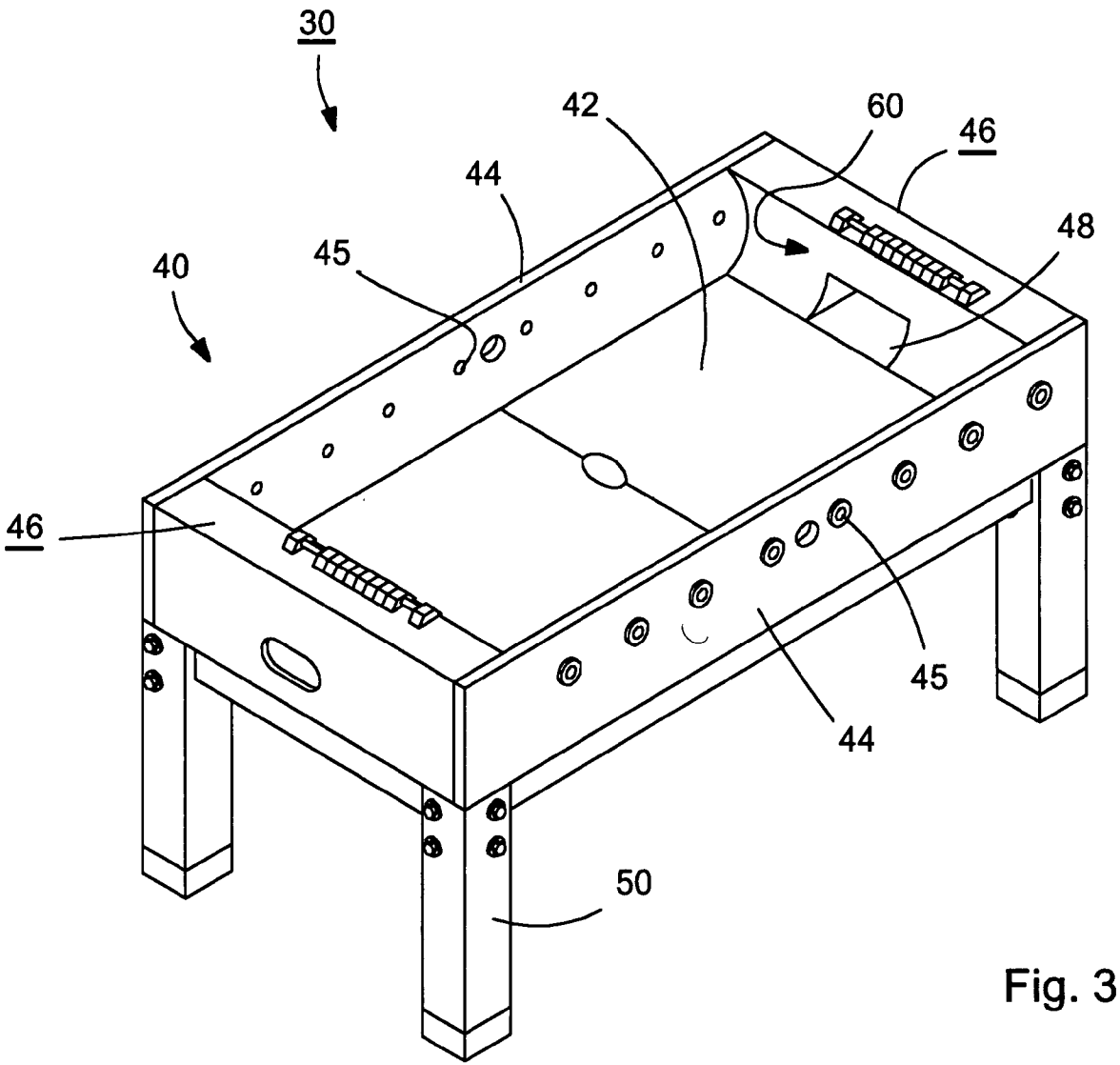
FIG. 3 is a perspective view of FIG. 2 without the control shank.

Please refer to FIGS. 2 and 3. According a first preferred embodiment, the soccer table of the present invention comprises the following elements.

A table frame 40 has a horizontal rectangular table board 42, two long frames 44 and two short frames 46. These frames 44, 46 are fixed on the two long and short sides of the table board 42 respectively, and are higher than the table board. Each the short frame 46 is formed an opening 48.

Multiple table legs 50 are fixed on the table frame 40.

A predetermined number of control shanks 55, which are passing through the perforations 45 of the two long frames 44 in parallel and can be translated and turned by player.

Many anthropomorphic shift blocks 56 are mounted on and controlled by the control shanks 55 respectively.

The abovementioned structure is same as the prior soccer table and thus will not be further described hereinafter.

Figure 4:
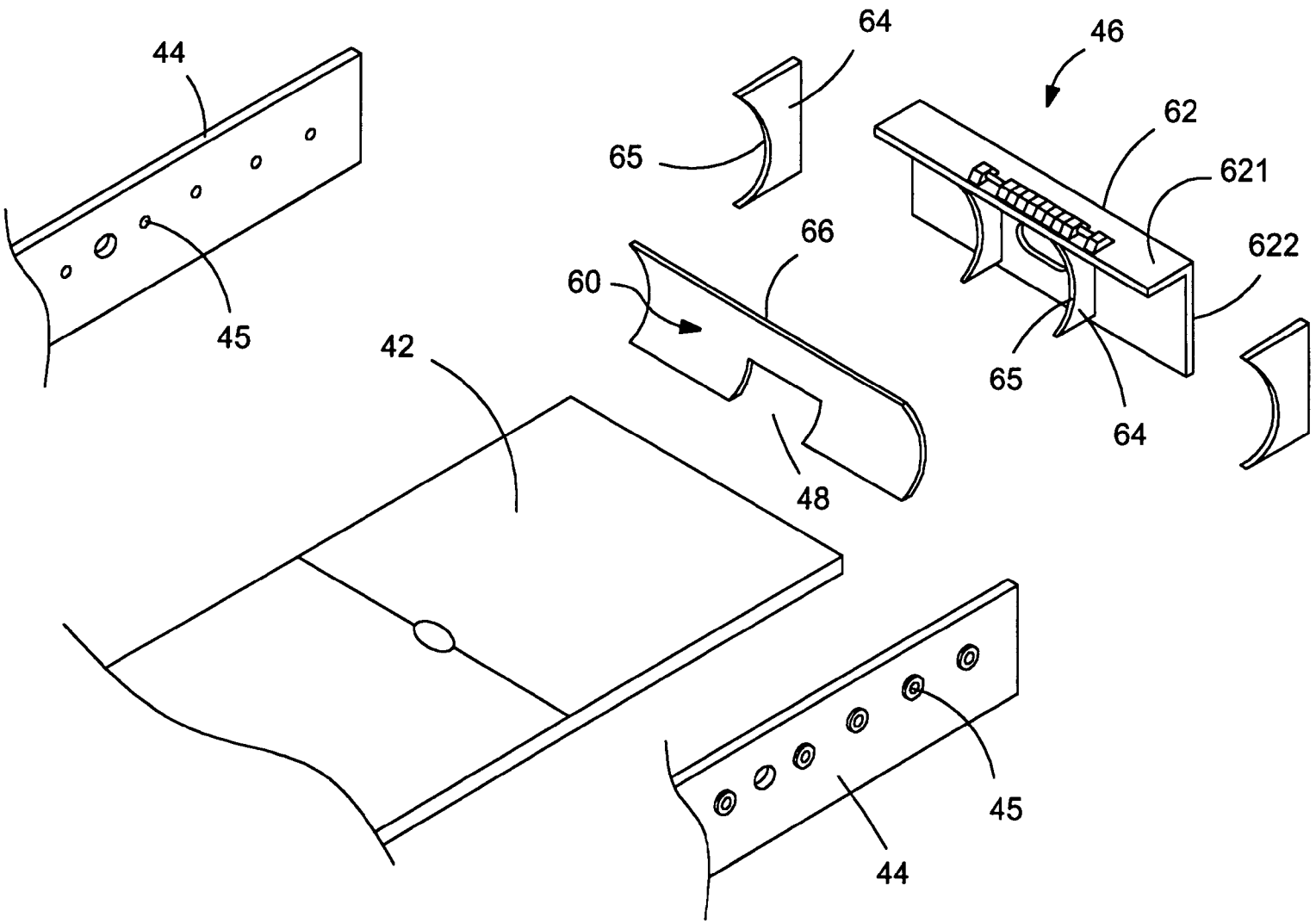
FIG. 4 is a partial exploded view of FIG. 3.
Figure 5:
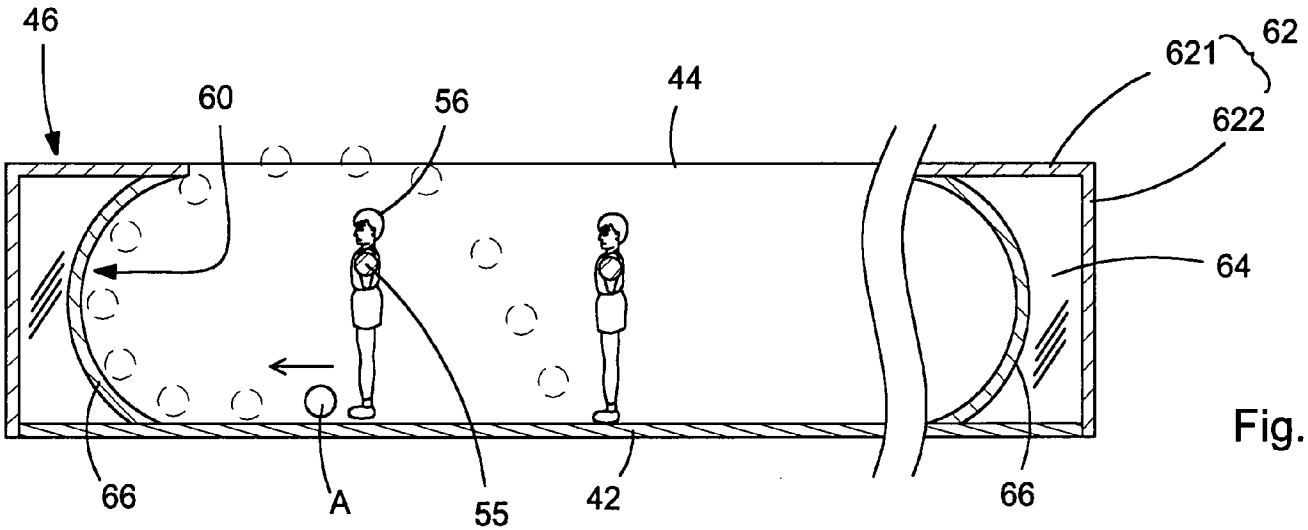
FIG. 5 is a sketch map of the present invention under use.

The characteristic of the present invention is in that:

A concave curve surface 60 is inwards recessed on the inner side of each short frame 46, which shapes arc in the vertical section while straight in the horizontal section. As shown in the FIG. 4, each the short frame 46 of the embodiment is composed of an external plate 62, four rib plates 64 and an arc plate 66, in which the external plate 62 is reverse L-shaped, having a horizontal plate portion 621 connected with a vertical plate portion 622, while the rib plates 64 are fixed within the external plate 62 at intervals, an inner edge of each rib plate has an arc notch 65. The arc plate 66 is arc in the vertical section, making the concave form the curve surface 60. The opening 48 of the short frame is formed on the arc plate. The arc plate 66 is fixed in the notches 65 of the rib plates 64 for positioning and shaping; a top edge of the arc plate is connected to the front edge of the horizontal plate portion 621 of the external plate 62. As shown in FIG. 5, the bottom edge of the arc plate 66 is jointed with the table board 42 neatly after the connection of the short frame 46 and table board 42.

While the game begins, as shown in FIG. 2, put a ball on the table board. One player controls the control shanks 55' on one side of the soccer table 30 to control the black shift block 56' and move the ball toward the short frame 46' of one end of the soccer table. Contrarily, another player controls the control shanks 55" on another side to control the white shift block 56" and move the ball to the short frame 46" of another end of the soccer table. The player who moves the ball into the goal (i.e. opening 48) obtains scores.

As shown in FIG. 5, as far as the anthropomorphic shift block 56 concerned, the left side is front court, while the right side is back court, and the shift blocks would be controlled by the player to hit the ball toward the short frame 46 on the left. When the ball (A) is moved forward by the shift block, it would shoot the goal possibly. Otherwise the ball will touch and move along the curve surface 60, and shoot off from the top edge of the curve surface and rebound on the table board 42 having a form of a parabola. Thus an effect of flying in the air and rebounding back is achieved. Comparing with that the ball on the prior soccer table only rebound horizontally, the rebounding effect of the present invention are more interesting and original.

In addition, when the ball overflies and rebounds, it is hard to stop the ball for the shift block 56. Therefore the rebounding distance of the ball is longer, the ball can return to the center of the table board easily, the chances the opponent can stop ball with shift block would be reduced.

Figure 6:
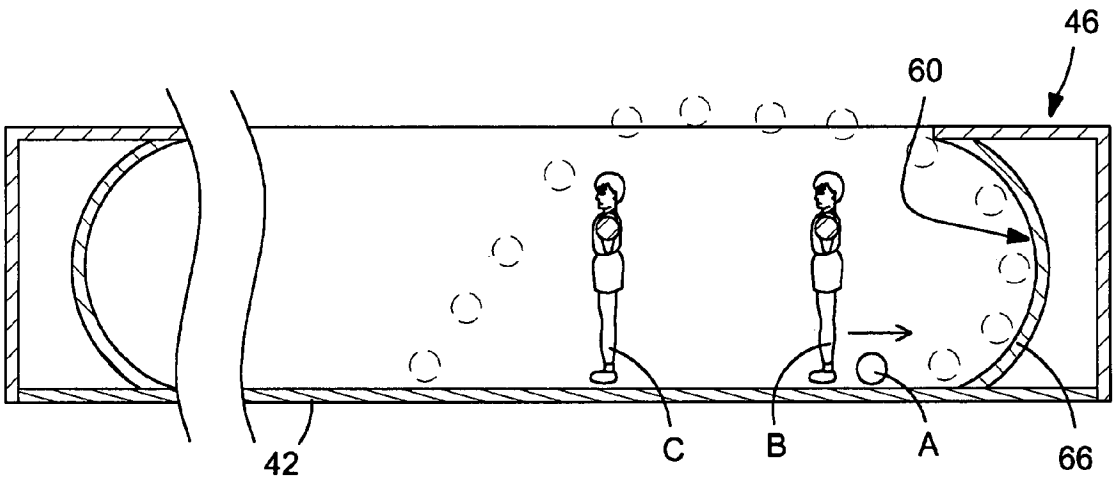
FIG. 6 is another sketch map of the present invention under use.

Concerning passing a ball, besides the traditional way, i.e. the player moves the ball with the shift block at the back court to the shift block at the front court, the present invention provides another different one. As shown in FIG. 6, based on the curve surface 60 design, the player can move backward the ball (A) with the shift block (B) at the back court and make the ball fly forward along the curve surface 60 of the short frame on the right, so that the ball can be passed to the shift block (C) at the front court. Therefore it is another characteristic of the present invention that move the ball backward and the ball be passed forward, making the play on the soccer table never be unchangeable. The prior soccer table fails to have this function.

Furthermore, according to the practical tests, when the ball does not touch the curve surface in a positive direction but a sideway direction, the rebounding ball forms a curve track, like banana shot on the soccer stadium.

Figure 7:
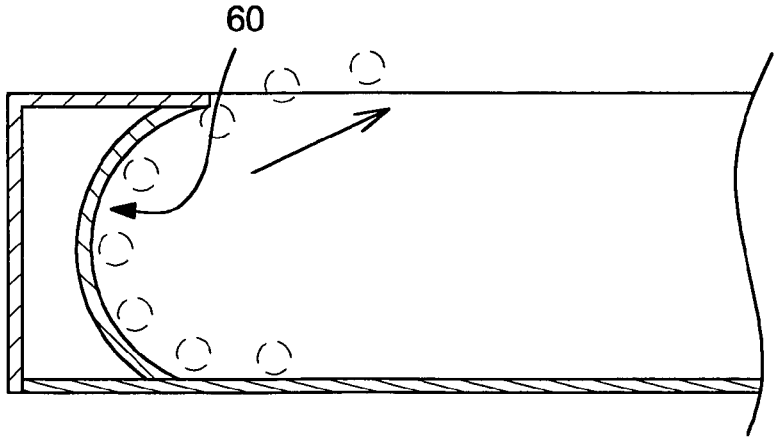
FIGS. 7 to 9 show the sketch map of curve surface in different curvature of the soccer table the present invention provides.
Figure 8:
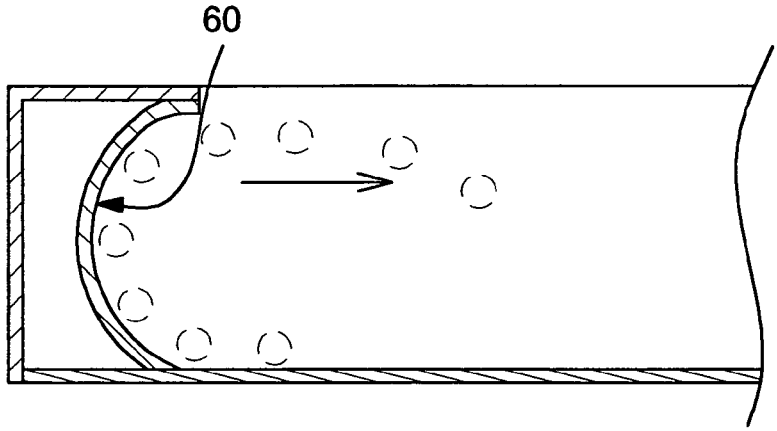
Figure 9:
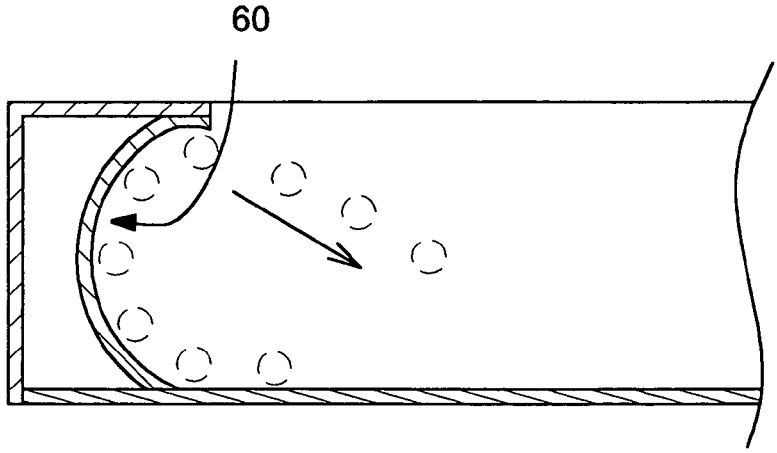

Please refer to FIGS. 7 to 9, the angle of departure of top edge of the curve surface 60 of the present invention can be formed different, making the angle and distance of reflection different.

Figure 10:
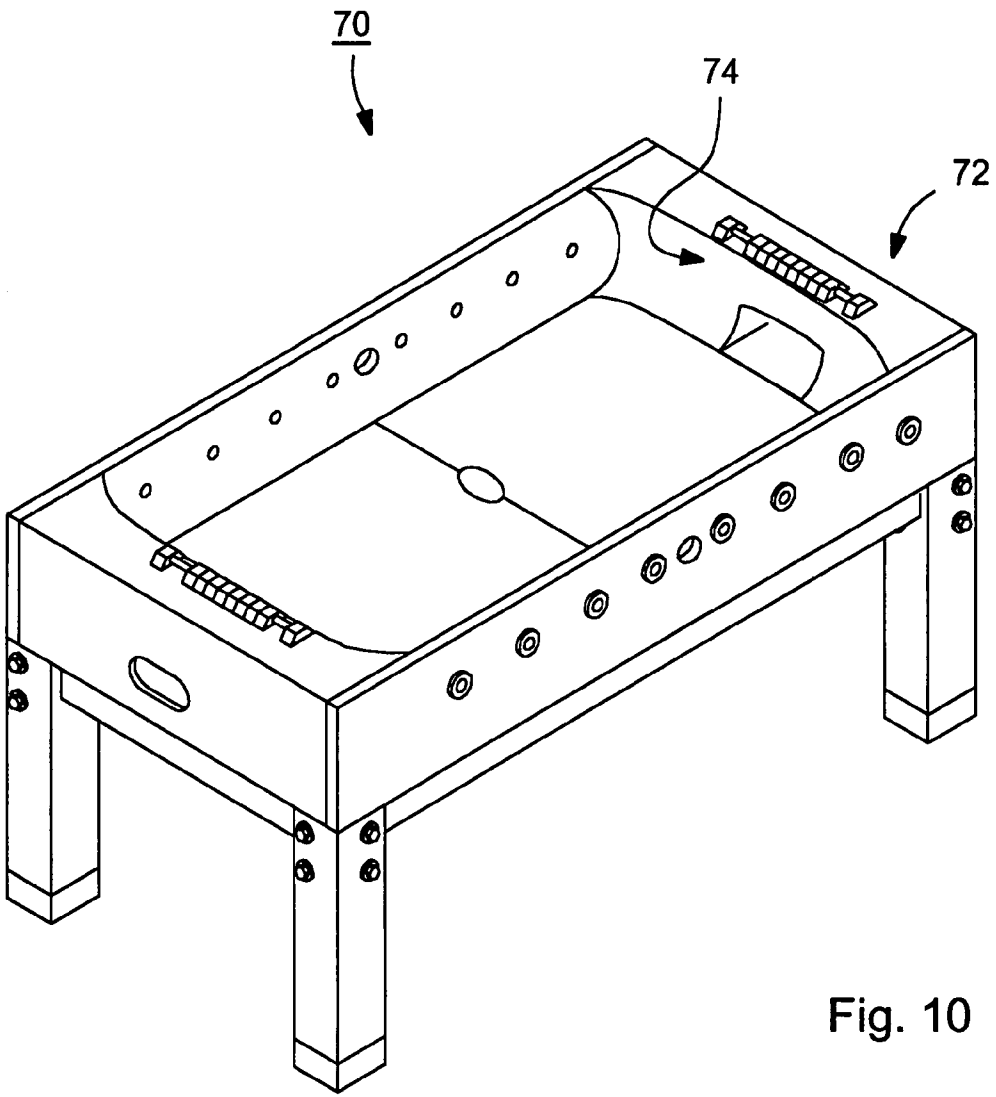
FIG. 10 is a perspective view of a second embodiment of the soccer table of the present invention without the control shank.

FIG. 10 is another preferred embodiment of the present invention. The inner sides of short frames 72 of the soccer table 70 are respectively formed a concave curve surface 74 inwards, in which, the curve surface 74 shapes arc both in the vertical and horizontal sections. Therefore when the ball touches the curve surface from different positions and rebounds, the angle the ball reflects to the table board would be different for strengthening the entertainment interest based on the uncertain angle of reflection.

It is practicable that the curve surface is not only set on the inner side of the short frame, but also on the inner side of the long frame.

Figure 11:
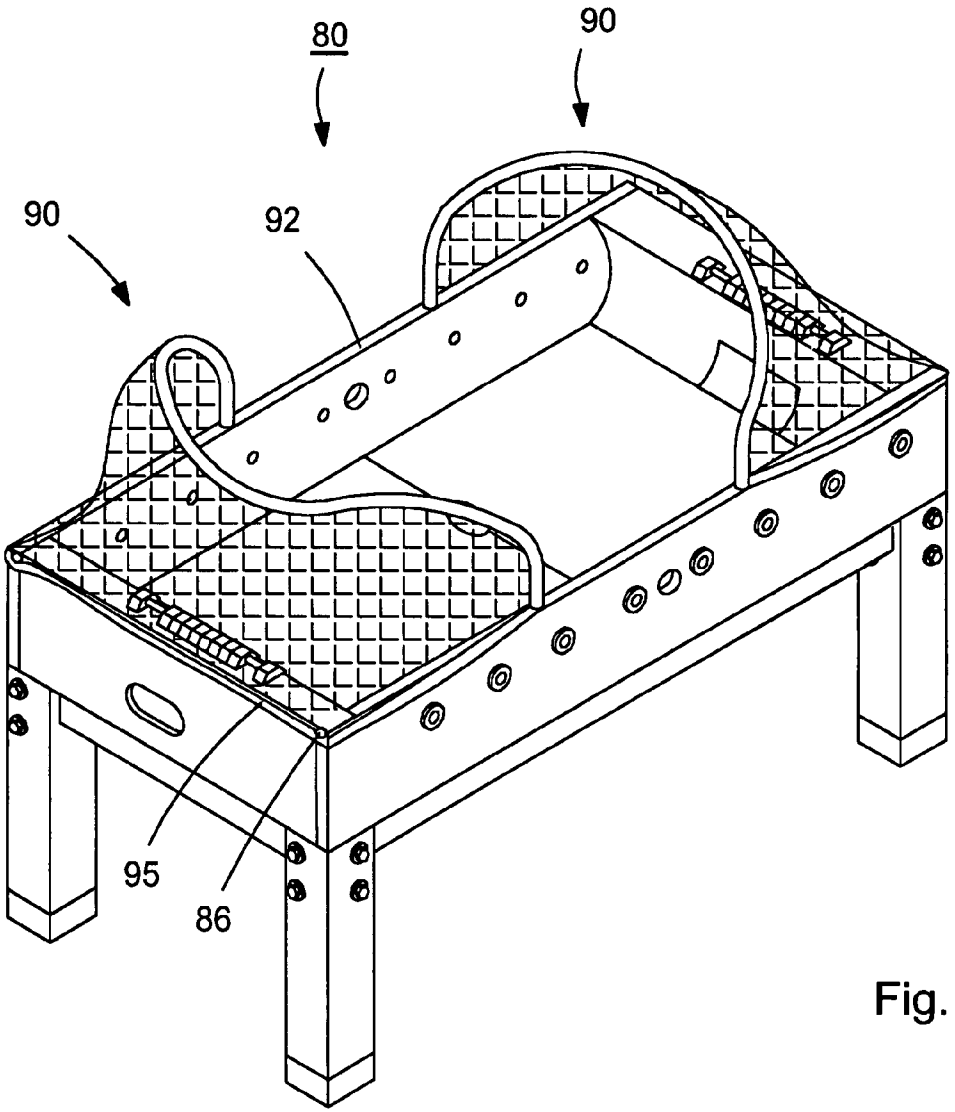
FIG. 11 is a perspective view of a third embodiment of the present invention without the control shank.
Figure 12:
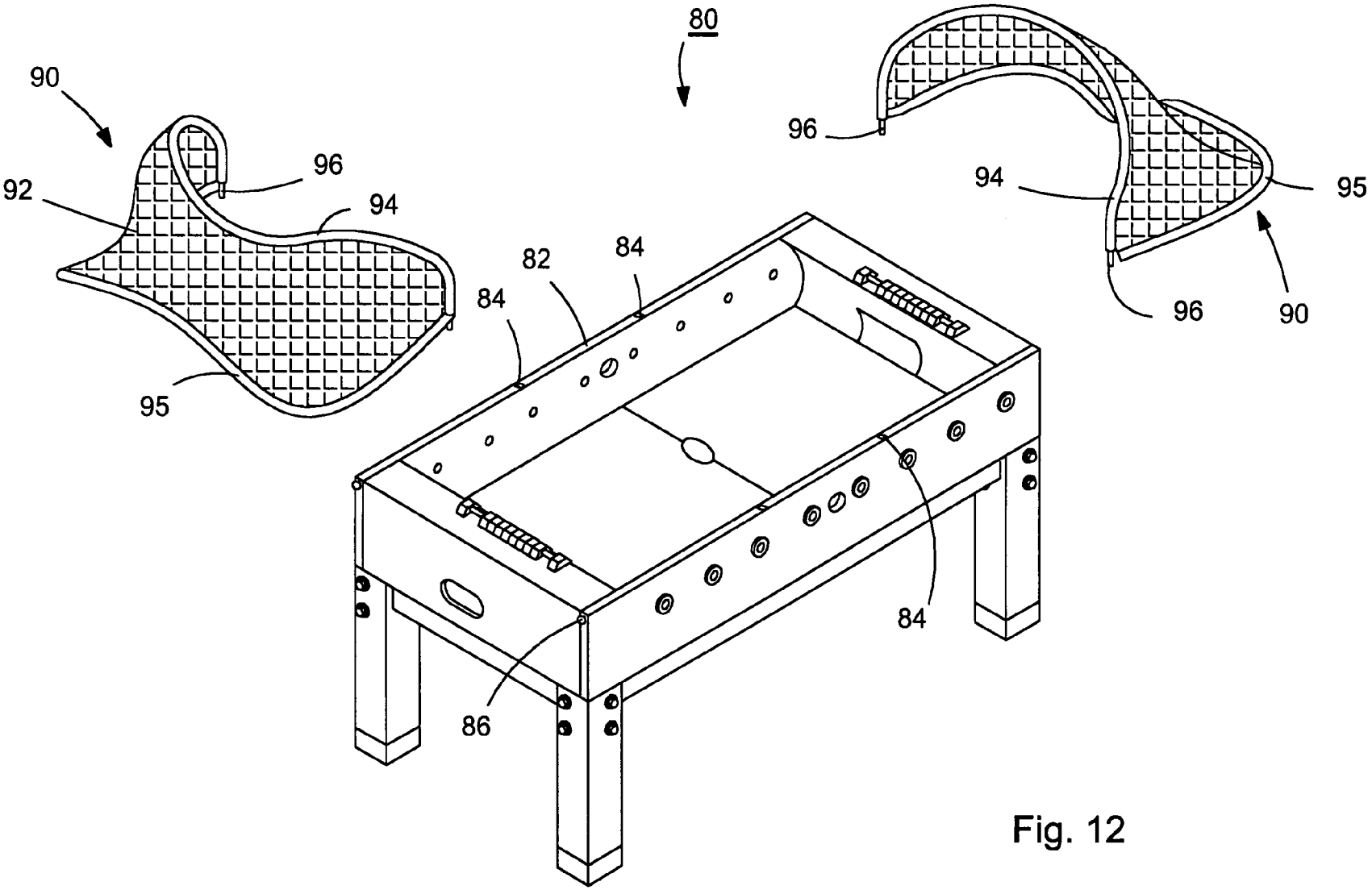
FIG. 12 is a perspective exploded view according to FIG. 11.

FIGS. 11 and 12 show the third preferred embodiment of the soccer table of the present invention, further including two protective nets 90.

Each protective net 90 comprises a net body 92; two cloth strip 94, 95 mounted on the front and back edges of the net body respectively. An iron wire passes through the first cloth strip 94, two ends of which extrude the cloth strip 94 downwards, forming two connection parts 96. The iron wire supports the front edge of the protective net to form an arch. Each the protective net 90 is fixed by means of inserting the two connection parts 96 into the two nests 84 formed on the top surface of the long frames 82. And the back edge of the protective net 90 is hooked on the two nails 86 located on the both sides of each end of the soccer table with the second cloth strip 95.

As shown in FIG. 11, the two nets 90 cover two ends of the soccer table respectively after mounting, which can prevent the ball from springing out the soccer table and protect the safety of players. Additionally, they have good appearance and can be removed from the soccer table.

In summary, the present invention is new and makes the playing diverse and produces more entertainment and interests.

The above embodiments are only used to illustrate the present invention, not intended to limit the scope thereof. Many modifications of the above embodiments can be made without departing from the spirit of the present invention.

What is claimed is:

1. A soccer table with special entertainment effect, comprising:

a table frame including a horizontal table board having four sides; two long frames and two short frames being mounted on said four sides of said table board respectively, and each of said frames extends upwardly above said table board; and an inner side of each short frame including an opening;

a predetermined number of control shanks on said two long frames in parallel and being translated and turned by a player; and a predetermined number of shift blocks mounted on and controlled by said control shanks;

said soccer table being characterized in that; a concave curved surface recessed on said inner side of each of said short frames, and said curved surface shapes define an upwardly extending arc in a vertical section; and wherein each of said short frames include an external plate, several vertical ribs and an arc plate supported by said several vertical ribs and wherein said arc plate includes an upwardly extending concave curved surface defining an arc in a vertical section and said arc plate being fixed on an inner side of said external plate and facing said table board and a pair of openings with one of said openings defined in a lower central portion of each of said arc plates.

2. The soccer table as claimed in claim 1, wherein said upwardly extending curved surface shapes define a straight line in the horizontal section.

3. The soccer table as claimed in claim 1, wherein said upwardly extending curved surface shapes define an arc in the horizontal section.

4. The soccer table as claimed in claim 1, wherein each of said short frames includes a predetermined number of rib plates, and wherein an inner edge of each rib plate having a notch, and said rib plates located between said external plate and said arc plate at intervals; and said arc plate positioned in said notches of said rib plates.

5. The soccer table as claimed in claim 1, wherein said external plate has a horizontal plate portion and a vertical plate portion, and wherein a rear edge of the horizontal plate portion being connected with a top edge of said vertical plate portion; and a top edge of the arc plate being connected with the horizontal plate portion.

6. The soccer table as claimed in claim 1, further comprises two protective nets covering two portions of said soccer table adjacent said short frames.

7. The soccer table as claimed in claim 6, wherein a front edge of each of the protective nets is arched; and wherein two connection parts are formed on both sides of the front edge of said protective net; the front edge of said protective net being fixed by means for connecting the two connection parts with the two long frames respectively; a rear edge of the protective net covering a periphery of one end of said soccer table.

8. The soccer table as claimed in claim 7, wherein two nails are respectively located on both sides of each end of the soccer table; and a rear edge of the protective net being hooked on said two nails.

* * * * *